US010559919B2

(12) United States Patent
Masuda et al.

(10) Patent No.: US 10,559,919 B2
(45) Date of Patent: Feb. 11, 2020

(54) CONNECTOR HAVING ELASTICALLY DEFORMABLE PRESSING PROTRUSIONS

(71) Applicant: YAZAKI CORPORATION, Tokyo (JP)

(72) Inventors: Satoki Masuda, Shizuoka (JP); Yoshinao Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/352,775

(22) Filed: Mar. 13, 2019

(65) Prior Publication Data

US 2019/0296485 A1 Sep. 26, 2019

(30) Foreign Application Priority Data

Mar. 20, 2018 (JP) ..... 2018-052911

(51) Int. Cl.

| | |
|---|---|
| ***H01R 13/60*** | (2006.01) |
| ***H01R 13/629*** | (2006.01) |
| ***H01R 13/502*** | (2006.01) |
| ***H01R 13/52*** | (2006.01) |
| ***H01R 13/639*** | (2006.01) |
| ***H01R 13/193*** | (2006.01) |
| ***H01R 13/436*** | (2006.01) |
| ***H01R 13/506*** | (2006.01) |

(52) U.S. Cl.

CPC ..... *H01R 13/62955* (2013.01); *H01R 13/193* (2013.01); *H01R 13/4365* (2013.01); *H01R 13/502* (2013.01); *H01R 13/506* (2013.01); *H01R 13/5202* (2013.01); *H01R 13/62938* (2013.01); *H01R 13/639* (2013.01); *H01R 2201/26* (2013.01)

(58) Field of Classification Search

CPC ..... H01R 13/62933; H01R 13/62938; H01R 13/62955; H01R 13/62988

USPC ..... 439/157, 685, 607.41, 607.58

See application file for complete search history.

(56) References Cited

U.S. PATENT DOCUMENTS 8,485,844 B2 * 7/2013 Omae ..... H01R 13/5202 439/559

9,431,771 B1 8/2016 Sundarakrishnamachari et al.

(Continued)

FOREIGN PATENT DOCUMENTS

EP 2 006 958 A2 12/2008

JP 2011-119120 A 6/2011

*Primary Examiner* — Phuong K Dinh

(74) *Attorney, Agent, or Firm* — Kenealy Vaidya LLP

(57) ABSTRACT

A connector includes a terminal-equipped electrical wire, an inner housing, an outer housing, and a front holder. The terminal-equipped electrical wire includes an electrical wire and a terminal, the terminal having a box-shaped portion configured to fit with a mating terminal in a fitting direction intersecting with an extending direction of the electrical wire. The inner housing includes a terminal accommodating chamber. The outer housing includes an electrical wire leading-out opening and a housing fitting opening. One or more pressing protrusions are provided on at least one of the terminal and the front holder. When the outer housing is fitted to the mating connector, the one or more pressing protrusions are elastically deformed by a fitting pressing force acting on the front holder to press and urge the box-shaped portion toward inside of the terminal accommodating chamber.

4 Claims, 14 Drawing Sheets

(56) References Cited

U.S. PATENT DOCUMENTS

| | | | | |
|---|---|---|---|---|
| 2012/0100753 | A1 | 4/2012 | Omae et al. | |
| 2013/0252446 | A1* | 9/2013 | Forell | H01R 13/62938 439/157 |
| 2013/0280935 | A1* | 10/2013 | Shishikura | H01R 13/62977 439/157 |
| 2014/0206213 | A1* | 7/2014 | Kato | H01R 13/533 439/157 |

* cited by examiner

CONNECTOR HAVING ELASTICALLY DEFORMABLE PRESSING PROTRUSIONS

CROSS REFERENCE TO RELATED APPLICATIONS

This application is based on Japanese Patent Application (No. 2018-052911) filed on Mar. 20, 2018, the contents of which are incorporated herein by reference.

BACKGROUND OF THE INVENTION

1. Field of the Invention

The present invention relates to a connector.

2. Description of the Related Art

There is known a connector provided with a terminal which is fitted with a mating connector in a direction intersecting with an extending direction of an electrical wire of the terminal (see JP-A-2011-119120). As shown in FIG. 14A, a terminal 501 of this type is attached to an end of an electrical wire 503 to form a terminal-equipped electrical wire 505. The terminal of the terminal-equipped electrical wire 505 is accommodated by, for example, being inserted into an inner housing 507 in an insertion direction X along an extending direction of the electrical wire 503. The insertion direction X of the terminal-equipped electrical wire 505 intersects with (perpendicularly intersects in the figure) a fitting direction Y of the terminal 501 with a mating of the terminal 501. The terminal 501 is a female terminal including a rectangular box-shaped fitting portion 510.

The inner housing 507 includes a pair of terminal accommodating chambers 509. The inner housing 507 further includes terminal fitting openings 511 and electrical wire leading-out openings 513. An electrical wire enclosing wall 515 is formed integrally between the terminal fitting openings 511 and the electrical wire lead-out openings 513. The terminal fitting openings 511 expose the fitting portions 510 of a pair of terminals 501. A mating terminal (not shown in the figure), which is a male terminal, is fitted to the fitting portion 510 of the terminal 501 exposed at the terminal fitting opening 511. In the electrical wire leading-out opening 513, the terminal-equipped electrical wire 505 is inserted from the terminal 501, and the electrical wire 503 connected to the terminal 501 is led out from the electrical wire leading-out opening 513.

As shown in FIG. 14B, the terminal 501 is inserted into the inner housing 507 in which a locking protrusion 520 is locked to a terminal lock 517 which is a flexible locking portion provided in the terminal accommodating chamber 509. The terminal lock 517 is formed of a cantilevered flexible piece whose proximal end is connected to the inner housing 507 and whose distal end is a free end. A locking claw 519 is formed at the distal end of the terminal lock 517. When the terminal 501 is inserted into the electrical wire leading-out opening 513, the terminal lock 517 is elastically restored by accommodating the terminal 501 at a predetermined position after being bent toward the outside of the terminal accommodating chamber 509, thereby locking the locking protrusion 520 provided at a rear end of the fitting portion 510 and retaining the terminal 501.

The inner housing 507 accommodating the terminal 501 is further accommodated inside an outer housing (not shown). The inner housing 507 is accommodated by being inserted into the outer housing in the insertion direction X along the extending direction of the electrical wire 503. Accordingly, the fitting portion 510 of the terminal 501 accommodated in the inner housing 507 is exposed from a housing fitting opening of the outer housing, and the electrical wire 503 led out from the inner housing 507 is led out from an electrical wire leading-out opening of the outer housing.

However, although the terminal 501 accommodated in the inner housing 507 is retained by the terminal lock 517 provided in the terminal accommodating chamber 509, the terminal 501 is accommodated in the terminal accommodating chamber 509 with a clearance. Therefore, when the connector is used in an automobile or the like, the terminal 501 vibrates in the terminal accommodating chamber 509 due to vibrations during running of the automobile, which causes friction occurs between the terminal 501 and the mating terminal. Thus, contact resistance may become unstable.

In order to suppress the vibration of the terminal 501 accommodated in the terminal accommodating chamber 509, a press-fit rib may be provided on an inner wall of the terminal accommodating chamber 509, and the terminal 501 may be press-fitted into the terminal accommodating chamber 509. However, when the terminal 501 is press-fitted into the terminal accommodating chamber 509, the metal terminal 501 may shave the press-fitting rib, and resulting wearing powder may adhere to a contact point of the metal terminal 501 which causes a connection failure.

SUMMARY OF THE INVENTION

The invention is made in view of the above circumstances, and an object of the invention is to provide a connector having improved connection reliability by suppressing rattling of a terminal in an inner housing.

The above object according to the invention is achieved by the following configurations.

(1) A connector, including: a terminal-equipped electrical wire that includes an electrical wire and a terminal which is attached to an end portion of the electrical wire, the terminal having a box-shaped portion configured to fit with a mating terminal in a fitting direction intersecting with an extending direction of the electrical wire, an inner housing that includes a terminal accommodating chamber communicating with a terminal fitting opening and an electrical wire leading-out opening and configured to accommodate the terminal-equipped electrical wire, an outer housing that includes an electrical wire leading-out opening configured to receive the inner housing in the extending direction of the electrical wire and a housing fitting opening configured to be fitted to a mating connector, a front holder configured to be attached to the housing fitting opening, and one or more pressing protrusions provided on at least one of the terminal and the front holder. When the outer housing is fitted to the mating connector, the one or more pressing protrusions are elastically deformed by a fitting pressing force acting on the front holder to press and urge the box-shaped portion toward inside of the terminal accommodating chamber.

According to the connector having the configuration (1), the pressing protrusion is provided on at least one of the terminal and the front holder. When the connector is fitted to the mating connector, the pressing protrusion is elastically deformed by a fitting pressing force acting on the front holder to press and urge the box-shaped portion of the terminal toward inside of the terminal accommodating chamber. Accordingly, the terminal is prevented from rattling in the terminal accommodating chamber. As a result, even when the connector is used in an automobile or the like, the terminal is prevented from vibrating in the terminal accommodating chamber caused by vibrations during running, and friction is less likely to occur between the terminal and the mating terminal.

(2) The connector according to (1) described above, wherein a plurality of the pressing protrusions are provided at equal intervals and along a periphery of a terminal insertion opening of the front holder opposing a distal end surface of the box-shaped portion in the fitting direction.

According to the connector having the configuration (2), the plurality of pressing protrusions provided at equal intervals and along the periphery of the terminal insertion opening of the front holder can uniformly press and urge the distal end surface in the fitting direction of the box-shaped portion of the terminal accommodated in the terminal accommodating chamber. Accordingly, the box-shaped portion of the terminal is reliably prevented from rattling and inclining in the terminal accommodating chamber.

(3) The connector according to (1) or (2) described above, wherein a temporary locking mechanism is provided between the front holder and the inner housing to hold the front holder in a temporary locking position where the box-shaped portion is not pressed and urged toward inside of the terminal accommodating chamber.

According to the connector having the configuration (3), the terminal insertion opening of the front holder held in the temporary locking position is located on the side of housing fitting opening of the outer housing apart from the terminal fitting opening of the inner housing. Therefore, when the connector is fitted to the mating connector, distal ends of the mating terminal can be easily inserted into the terminal insertion opening of the front holder, and the fitting operation becomes easy.

(4) The connector according to any one of (1) to (3), wherein a lever having cam grooves is rotatably provided on the outer housing, and the lever draws a mating housing of the mating connector to the outer housing by pulling in cam pins on the mating housing by rotation operation of the lever.

According to the connector having the configuration (4), the outer housing and the mating housing, which have been fitted together by the rotation operation of the lever for moving the cam pin to the fitting completion position of the cam groove, are constantly urged in the connector fitting direction by cam action. Therefore, the front holder, on which the fitting pressing force always acts, can reliably urge the box-shaped portion of the terminal toward inside of the terminal accommodating chamber.

According to the connector of the invention, a terminal can be prevented from rattling in the inner housing and connection reliability can be improved.

The invention has been briefly described above. Further, the details of the invention will be further clarified by reading through embodiments for carrying out the invention (hereinafter referred to as "Embodiment") described below with reference to attached drawings.

DETAILED DESCRIPTION OF THE EXEMPLARY EMBODIMENTS

Hereinafter, embodiments according to the invention will be described with reference to drawings.

Figure 1:
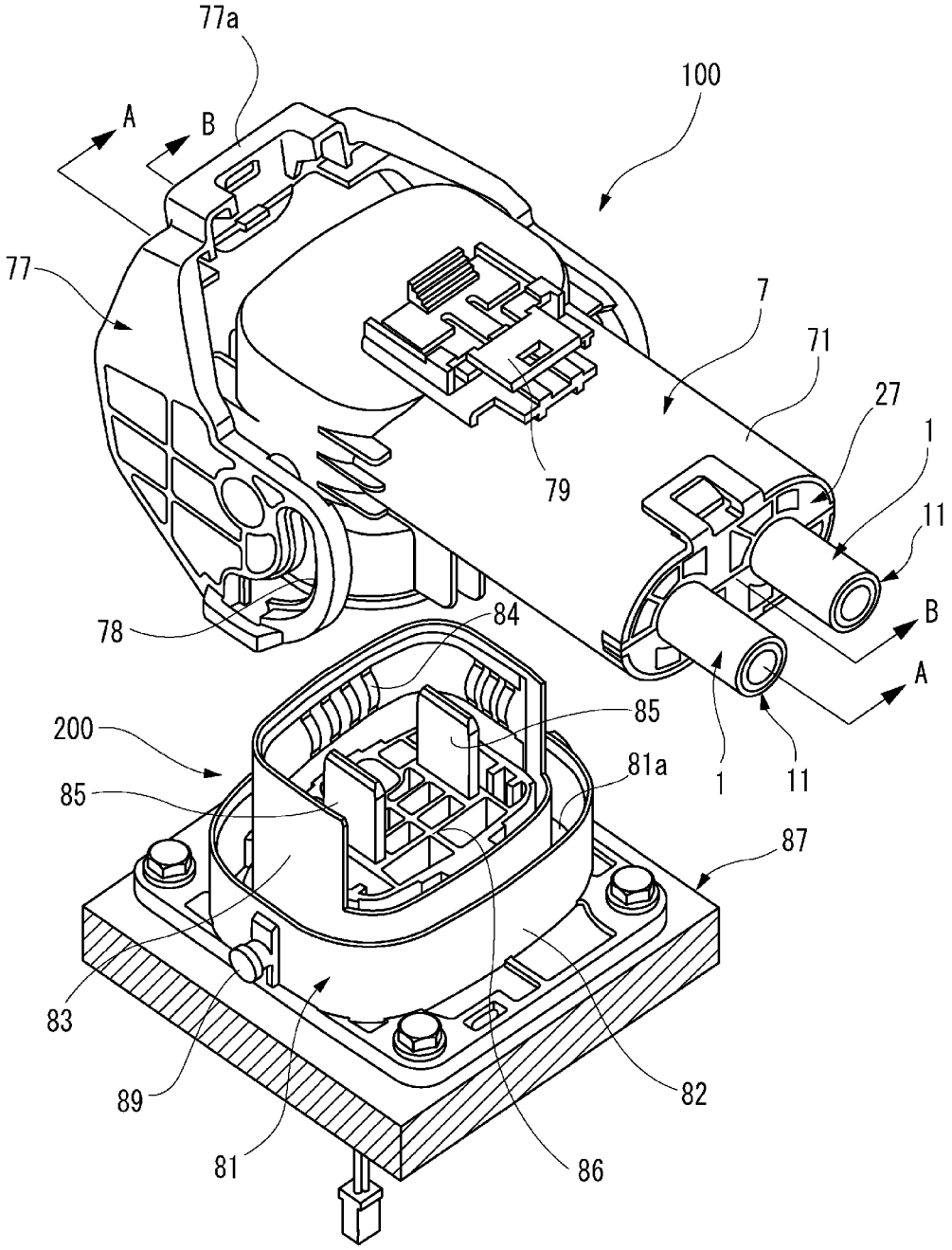
FIG. 1 is a perspective diagram showing a connector and a mating connector according to Embodiment 1 of the invention in a state immediately before the connector is fitted to the mating connector.
Figure 2:
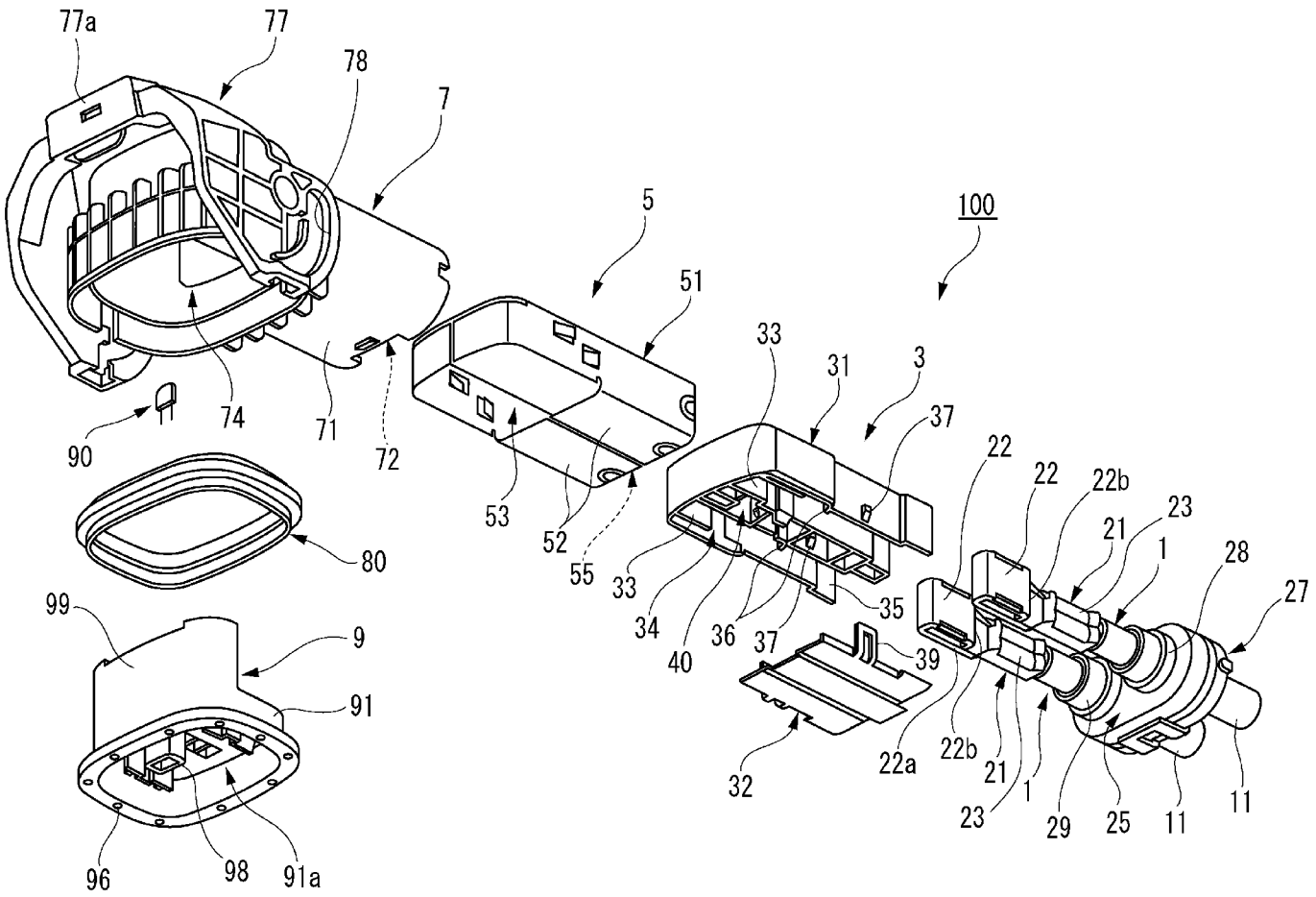
FIG. 2 is an exploded perspective diagram of the connector shown in FIG. 1.
Figure 3:
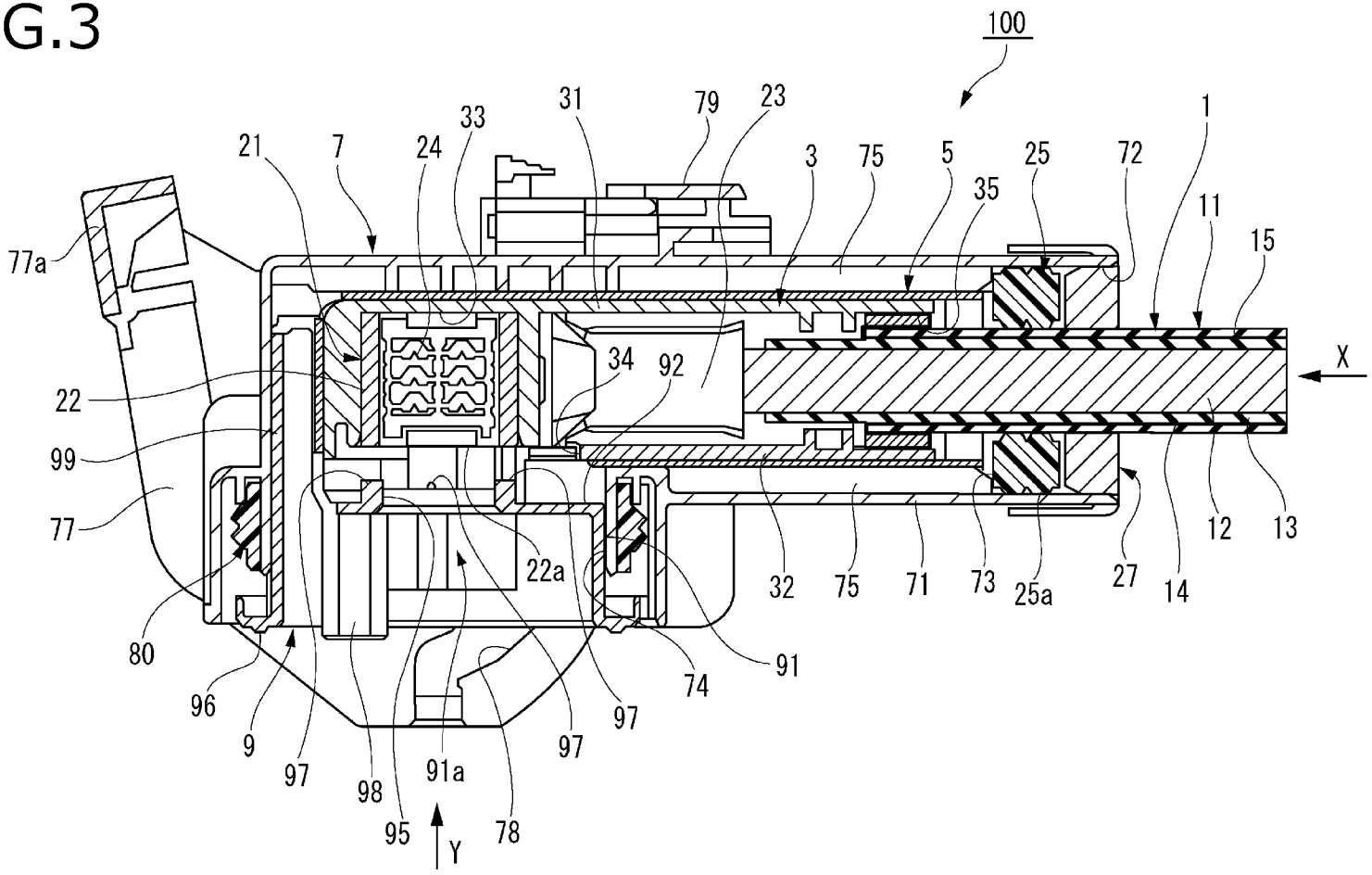
FIG. 3 is a cross section diagram of the connector shown in FIG. 1, taken along a line A-A in FIG. 1.
Figure 4:
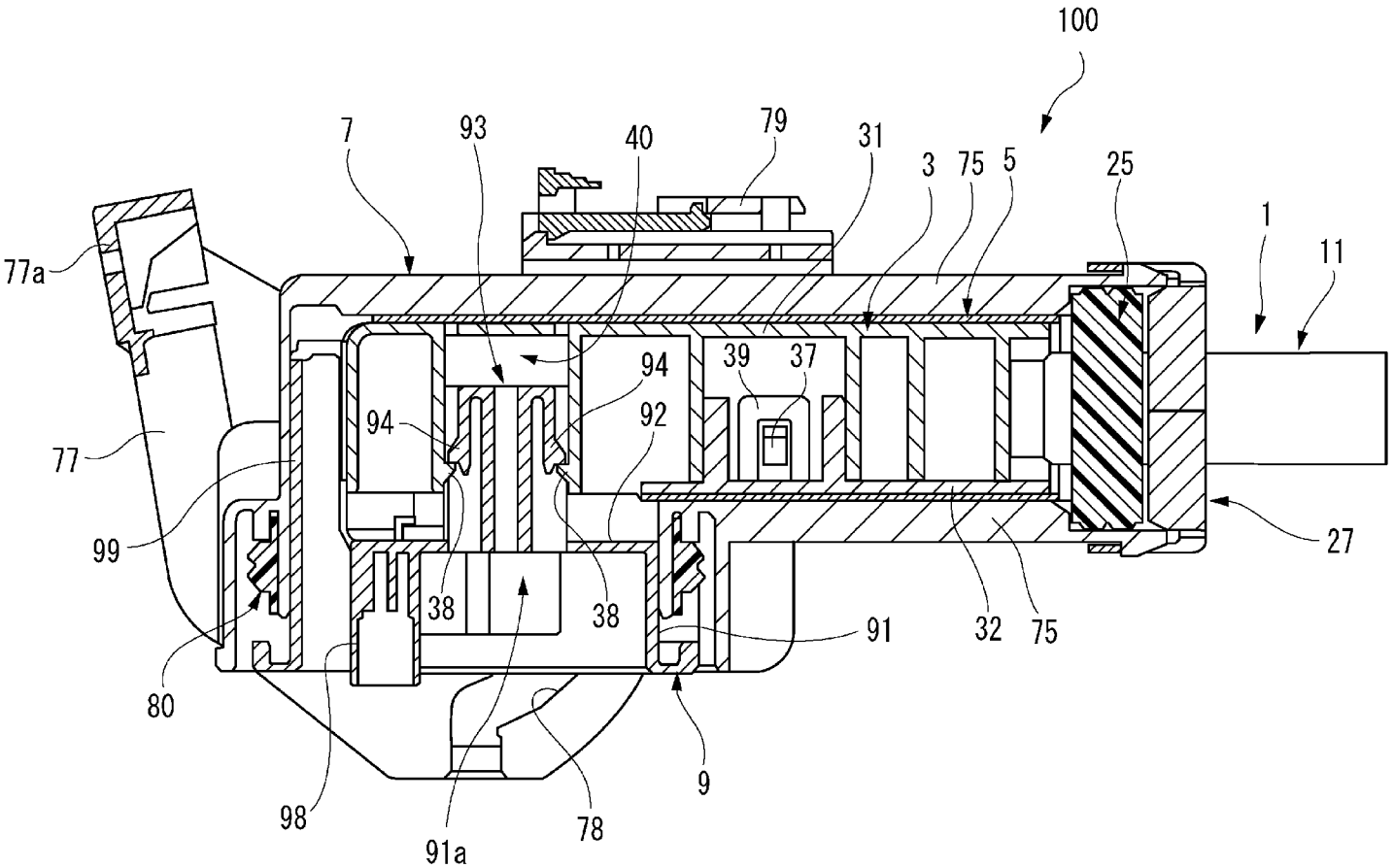
FIG. 4 is a cross section diagram of the connector shown in FIG. 1, taken along a line B—B in FIG. 1.

FIG. 1 is a perspective diagram showing a shielded connector 100 and a mating connector 200 according to Embodiment 1 of the invention in a state immediately before the shielded connector 100 is fitted to the mating connector 200; FIG. 2 is an exploded perspective diagram of the shielded connector 100 shown in FIG. 1; FIG. 3 is a cross section diagram of the shielded connector 100 shown in FIG. 1, taken along a line A-A in FIG. 1; and FIG. 4 is a cross section diagram of the shielded connector 100 shown in FIG. 1, taken along a line B-B in FIG. 1.

The shielded connector 100 according to the present embodiment is a lever fitting connector and accommodates terminals 21. As a basic configuration, the shielded connector 100 according to the present embodiment includes terminal-equipped electrical wires 1, an inner housing 3, a shield shell 5, an outer housing 7, and a front holder 9.

The mating connector 200 to which the shielded connector 100 is fitted includes a mating housing 81 to be fitted to the outer housing 7 and mating terminals 85 to be electrically connected to the terminals 21.

The connector of the invention is not limited to the lever fitting shielded connector according to the present embodiment, and can be applied to various types of connectors based on the gist of the invention.

In the shielded connector 100 according to the present embodiment, a lever 77 attached to the outer housing 7 is rotated in a R direction from a rotation start position (see FIG. 8) to a rotation completion position (see FIG. 10), whereby cam pins 89 provided in the mating housing 81 of the mating connector 200 are pulled in the outer housing 7 through cam grooves 78 formed in the lever 77, and the mating housing 81 is relatively drawn to the outer housing 7. Accordingly, the mating connector 200 is fitted to the shielded connector 100 with a low insertion force.

In the shielded connector 100, the lever 77 is rotated in a direction opposite to the R direction from the rotation completion position to the rotation start position, whereby the cam pins 89 are pushed out of the lever 77 through the cam grooves 78, and the outer housing 7 is pulled out from the mating housing 81. Accordingly, the pull-out force needed to detach the shielded connector 100 from the mating connector 200 is reduced by the operation of the lever 77.

As described above, the shielded connector 100 according to the present embodiment is a LIF (low insertion force) connector that is inserted into or removed from the mating connector 200 with a low insertion force by the operation of the lever 77.

In the terminal-equipped electrical wire 1 of the shielded connector 100, the terminal 21 is attached to an end of a shielded electrical wire 11 as shown in FIGS. 2 and 3.

The shielded electrical wire 11 is configured as a coaxial cable which includes a core wire 12, an inner sheath 13 covering the core wire 12, a conductive braid 14 covering the inner sheath 13, and an outer sheath 15 covering the braid 14, from the center of the cable.

The terminal 21 is electrically connected to the core wire 12 exposed at the end of the shielded electrical wire 11. A conductive shield terminal 29 is externally inserted to the braid 14 folded back at an end of the outer sheath 15 of the shielded electrical wire 11, and is conductively fixed to the braid 14 by a shield sleeve 28. Accordingly, the shielded electrical wire 11 turns into the terminal-equipped electrical wire 1 to which the terminal 21 and the shield terminal 29 are attached.

The terminal 21 includes a box-shaped portion 22 formed in a rectangular box shape by a sheet metal material. In the terminal 21, an opening portion opened at one side surface of the box-shaped portion 22 is a fitting portion to be fitted by the mating terminal 85 which is a male terminal. That is, the terminal 21 is formed as a female terminal. The terminal of the invention may be a male terminal including a box-shaped portion.

In the terminal-equipped electrical wire 1, a direction intersecting with an extending direction of the shielded electrical wire 11 is a fitting direction (direction of arrow Y) in which the terminal 21 is fitted to the mating terminal 85. The terminal 21 internally holds a terminal spring 24 that increases the conductivity with the mating terminal 85 (see FIG. 3).

In the present embodiment, the terminal 21 includes a conductor connecting portion 23 connected to the box-shaped portion 22 which is a terminal main body in a rectangular box shape. An edge portion 22*b* of the rectangular box shape of the box-shaped portion 22 is locked by a locking wall 36 of a terminal accommodating chamber 33 formed in the inner housing 3 which will be described below.

As shown in FIGS. 2 to 4, the inner housing 3 is made of rectangular box-shaped insulating resin. The inner housing 3 is inserted into a tubular portion 71 of the outer housing 7 in an inner housing insertion direction (direction of arrow X) along of the shielded electrical wire 11. In the present embodiment, the inner housing 3 includes an inner housing main body 31 and a cover 32. The inner housing main body 31 includes a pair of terminal accommodating chambers 33. That is, in the inner housing 3, the terminals of a pair of the terminal-equipped electrical wires 1 are accommodated in the pair of terminal accommodating chambers 33, respectively.

Each terminal accommodating chamber 33 is formed into a rectangular tube shape that accommodates the box-shaped portion 22 of the terminal 21 substantially without any gap. The electrical wire leading-out side of the terminal accommodating chamber 33 is opened as a slit at a position eccentric to the axis of the shielded electrical wire 11, and the conductor connecting portion 23 of the terminal 21 accommodated in the terminal accommodating chamber 33 is inserted through the electrical wire leading-out side. In the terminal accommodating chamber 33, the locking wall 36 remaining in a portion where the slit is not formed abuts the edge portion 22*b* of the box-shaped portion 22. Accordingly, the edge portion 22*b* is hooked by the locking wall 36, and the box-shaped portion 22 is restricted from falling toward the electrical wire leading-out side. That is, the terminal-equipped electrical wire 1 is retained.

The inner housing main body 31 includes a terminal fitting opening 34 communicating with the terminal accommodating chamber 33 and an electrical wire leading-out opening 35. The cover 32 is attached to the inner housing main body 31 so as to cover a portion between the terminal fitting opening 34 and the electrical wire leading-out opening 35. The cover 32 is attached to the inner housing main body 31 by locking lock pieces 39 on a plurality of lock protrusions 37 provided in the inner housing main body 31, respectively. Accordingly, the terminal accommodating chamber 33 can be opened freely by the cover 32.

Convex portions (not shown) are arranged in a protruding state in a surface of the cover 32 that opposes the shielded electrical wire 11. When the cover 32 is attached to the inner housing main body 31, the convex portion abuts the shielded electrical wire 11. That is, the shielded electrical wire 11 of the terminal-equipped electrical wire 1 is reliably held in the inner housing main body 31 by attaching the cover 32.

The cover 32 may be formed by integrally molding a cover portion with the inner housing main body via a hinge portion.

In the shield shell 5, a shell main body 51 is formed into a rectangular box shape by a sheet metal working performed on a conductive metal plate. The shield shell 5 includes terminal fitting openings 53 and electrical wire leading-out openings 55, and covers the inner housing 3. The terminal fitting openings 53 expose the box-shaped portions 22 of the pair of terminals 21, respectively. The mating terminals 85 are fitted to the terminals 21 exposed at the terminal fitting openings 53. The shielded electrical wires 11 led out from the electrical wire leading-out openings 35 of the inner housing 3 are led out from the electrical wire leading-out openings 55.

In the shield shell 5, a pair of cover plate portions 52 are formed between the terminal fitting openings 53 and the electrical wire leading-out openings 55, respectively. In the present embodiment, the pair of cover plates 52 are bent along an insertion direction of the shell (direction of the arrow X), and are configured into double-sided openings. The cover plate portions 52 may be, for example, one sheet.

Further, the cover plate portion 52 may be bent after the inner housing 3 is accommodated in the shield shell 5. The inner housing 3 may be inserted into the shield shell 5 from the electrical wire leading-out opening 55 when the cover plate portions 52 are bent in advance.

The tubular portion 71 of the outer housing 7 includes an electrical wire leading-out opening 72 for receiving the inner housing 3, which leads out the shielded electrical wire 11, in the inner insertion direction X along the extending direction of the electrical wire 11. The shielded electrical wire 11 is led out from the electrical wire leading-out opening 72 of the outer housing 7 accommodating the inner housing 3.

An inner peripheral seal surface 73 is formed in the electrical wire leading-out opening 72 of the outer housing 7. The inner peripheral seal surface 73 comes into close contact with a seal outer peripheral surface 25*a* (see FIG. 3) of a mat seal 25 attached on an outer periphery of the shielded electrical wires 11.

The mat seal 25 is made of an elastic material such as rubber, an inner periphery of the mat seal 25 comes into close contact with an outer periphery of the shield wires 11, and the seal outer peripheral surface 25*a* comes into close contact with the inner peripheral seal surface 73 of the outer housing 7. Accordingly, the mat seal 25 seals the space between the shielded electrical wires 11 and the tubular portion 71 of the outer housing 7 to prevent water coming into this space and ensure water-tightness.

The mat seal 25 is attached to the electrical wire leading-out opening 72 of the outer housing 7 and is restricted from falling from the tubular portion 71 by a holder 27.

At an end of the tubular portion 71 of the outer housing 7 opposite to the electrical wire leading-out opening 72, there is provided with a housing fitting opening 74 that opens in a fitting direction (direction of arrow Y) of fitting the terminals 21 to the mating terminals 85. The fitting direction intersects with the extending direction of the shielded electrical wire 11. That is, the outer housing 7 is configured into a substantially L-shaped tubular body.

The front holder 9 attached to the housing fitting opening 74 holds a connector packing 80 so as to cover a periphery of the fitting portion of the terminal 21 accommodated in the shielded connector 100.

A plurality of ribs 75 are provided on an inner wall of the tubular portion 71 of the outer housing 7. Protrusion tips of the ribs 75 protruding from the inner wall of the tubular portion 71 support the shield shell 5. The plurality of ribs 75 are formed on a deep side of the inner insertion direction X, which is deeper than the inner peripheral seal surface 73.

Since the plurality of ribs 75 arranged in a protruding state in the inner wall of the tubular portion 71 have gaps between each other, the contact area between the outer housing 7 and the shield shell 5 can be reduced when the shield shell 5 is inserted in the outer housing 7. Accordingly, insertion resistance between the shield shell 5 and the outer housing 7 can be suppressed, and insertion workability of the shield shell 5 can be enhanced. In addition, it is possible to reduce the weight of the outer housing 7 by reducing the resin material for forming the outer housing 7.

Further, a fitting position assurance lock 79 (CPA) is provided on an outer wall of the tubular portion 71 of the outer housing 7.

The fitting position assurance lock 79 has a half fitting prevention function. For example, in order to prevent the lock from falling out for some reason when the shielded connector 100 and the mating connector 200 are fitted together, it is configured to cover the lock and prevent the lock from returning.

Figure 5:
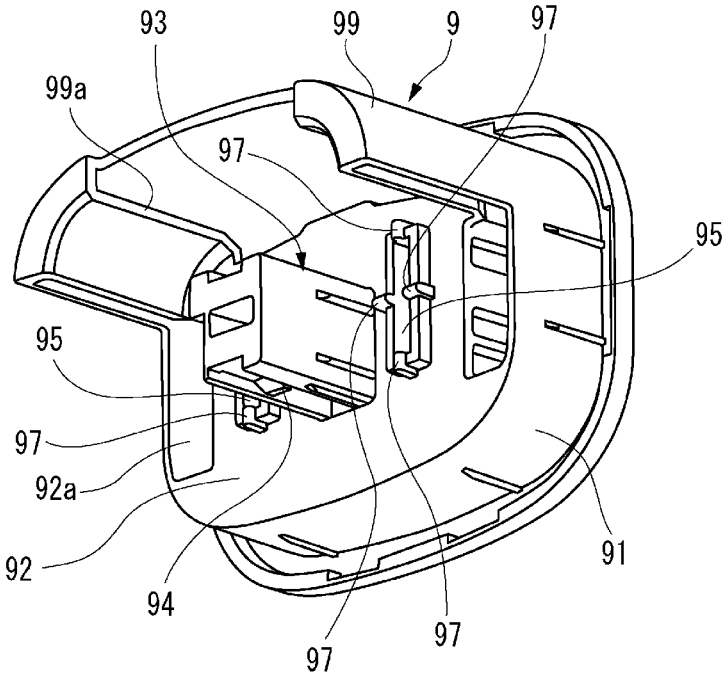
FIG. 5 is a bottom perspective diagram showing a front holder shown in FIG. 2.

FIG. 5 is a bottom perspective view of the front holder 9 shown in FIG. 2.

As shown in FIGS. 2 and 5, the front holder 9 attached to the housing fitting opening 74 of the outer housing 7 includes a bottomed tubular front holder main body 91 including a substantially rectangular recessed portion 91*a* into which a housing main body 86 of the mating connector 200 is fitted and a holder protrusion portion 99 extending in the fitting direction Y, from a bottom wall 92 of the front holder main body 91, and along a side wall of the front holder main body 91.

The holder protrusion 99 is provided opposing a side end (left end in FIG. 3) of the insertion direction X of the shield shell 5 when attached to the housing fitting opening 74 of the outer housing 7, and has a hollow structure into which a below-described housing protrusion portion 83 of the housing main body 86 is inserted. A cutout opening 99*a* is formed in an inner wall of the hollow holder protrusion portion 99.

A pair of terminal insertion openings 95 through which the mating terminals 85 of the mating connector 200 are inserted and a housing insertion opening 92*a* through which the housing protrusion portion 83 of the housing body 86 are inserted are formed in the bottom wall 92 of the front holder main body 91.

A terminal accommodating portion 98 accommodating a conductive pin 90 for short-circuiting is arranged in a protruding state on an inner surface of the bottom wall 92 opposing the housing main body 86. When the shielded connector 100 is fitted with the mating connector 200, the conductive pin 90 short-circuits an interlock terminal 201 accommodated in the housing main body 86. Accordingly, an interlock circuit is closed, the completion of connection with the mating connector 200 is detected, and the shielded electrical wire 11 can be energized.

As shown in FIG. 5, a columnar guide portion 93 that is fitted to a guide insertion portion 40 of the inner housing 3 protrudes from an outer surface of the bottom wall 92 opposing the terminal fitting opening 34 of the inner housing 3. Further, the columnar guide portion 93 is provided with flexible locking pieces 94 to be locked by locking protrusions 38 provided on an inner wall of the guide insertion portion 40. The flexible locking pieces 94 of the columnar guide portions 93 and the locking protrusions 38 of the guide insertion portion 40 constitute a temporary locking mechanism for holding the front holder 9 in a temporary locking position with respect to the inner housing 3 (see FIG. 4).

Further, a plurality of (four in the present embodiment) pressing protrusions 97 are provided at equal intervals, along the periphery of each of the terminal insertion openings 95, and on an outer surface of the bottom wall 92 of the front holder 9 opposing distal end surfaces 22*a* in the fitting direction of the box-shaped portions 22 of the terminals 21 accommodated in the terminal accommodating chamber 33 of the inner housing 3. When the shielded connector 100 is fitted with the mating connector 200, the pressing protrusions 97 are elastically deformed by a fitting pressing force acting on the front holder 9 to press and urge the box-shaped portion 22 toward inside of the terminal accommodating chamber 33.

Figure 6:
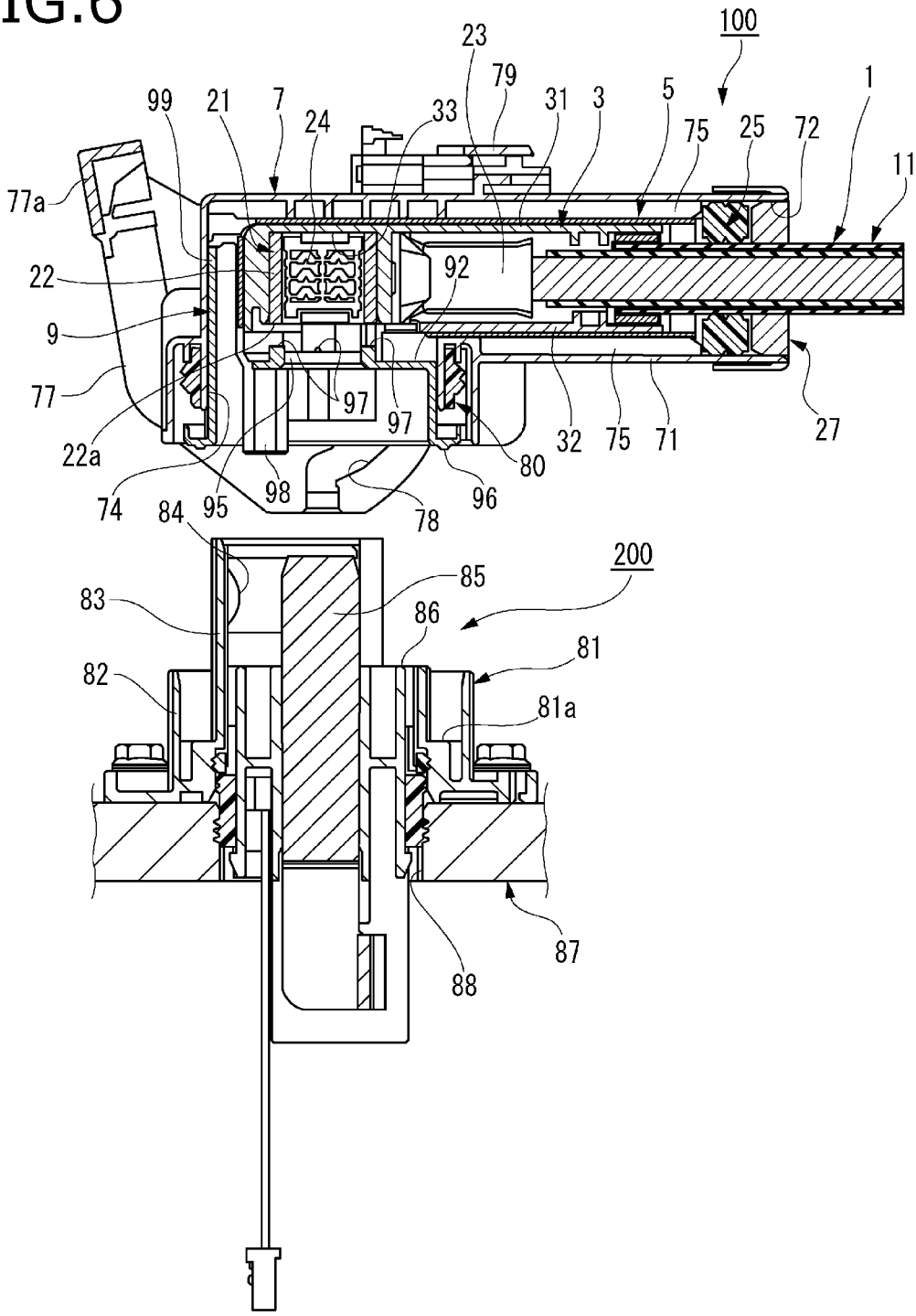
FIG. 6 is a cross section diagram of the connector and the mating connector shown in FIG. 1, taken along the line A-A in FIG. 1.
Figure 7:
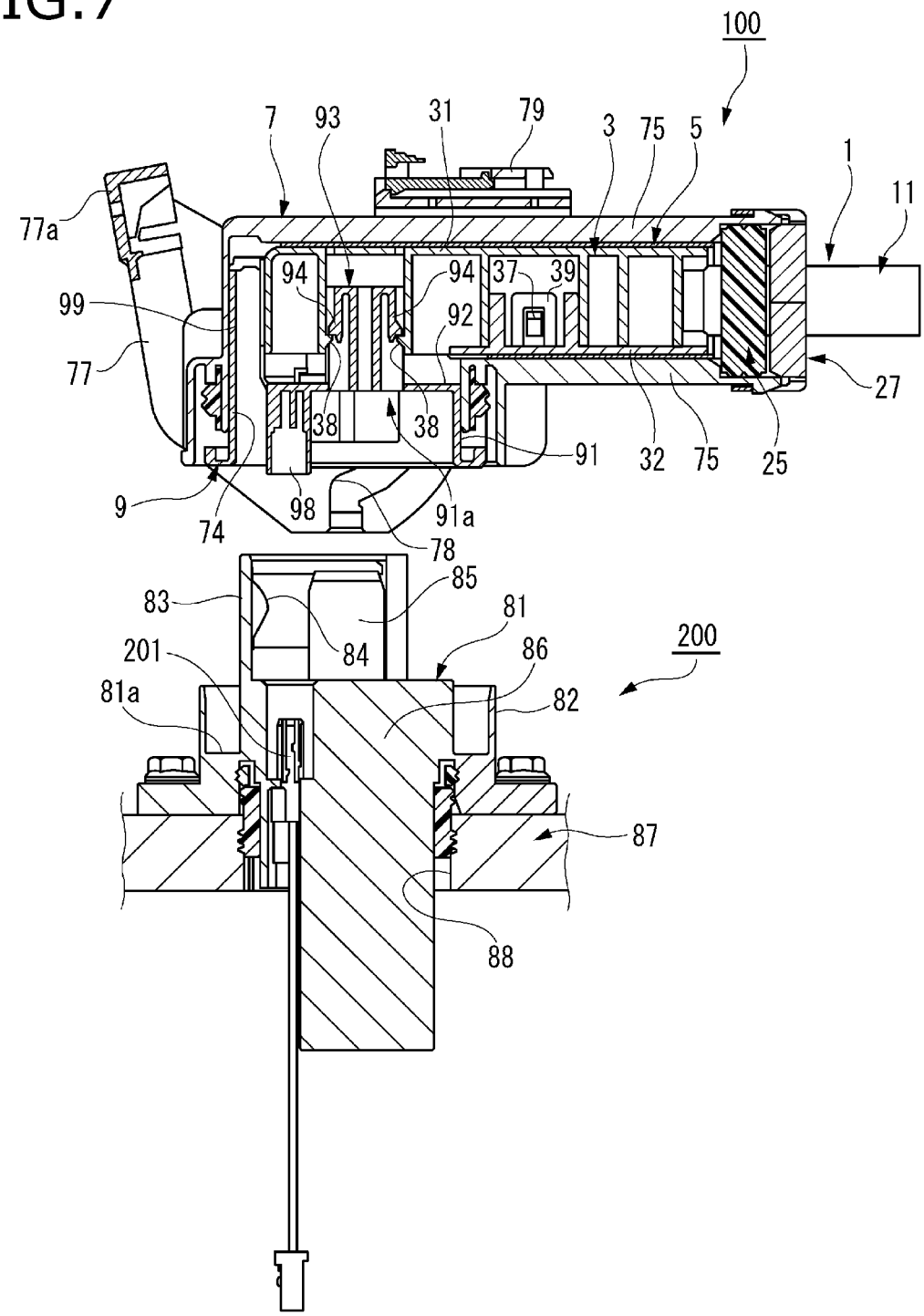
FIG. 7 is a cross section diagram of the connector and the mating connector shown in FIG. 1, taken along the line B-B in FIG. 1.

As shown in FIGS. 1, 6, and 7, the mating connector 200 according to the present embodiment includes the mating housing 81 that is fitted to the outer housing 7 and the mating terminals 85 that are electrically connected to the terminals 21. The mating connector 200 is liquid-tightly fitted into a mounting hole 88 formed in a cabinet 87 such as an inverter case, and is fastened by bolts.

The mating housing 81 includes the housing main body 86 for holding a pair of mating terminals 85, an annular hood portion 82 for covering the outer periphery of the housing main body 86, an annular recessed portion 81*a* formed between the housing main body 86 and the annular hood portion 82, and a housing protrusion portion 83 having a U-shaped cross section which is arranged in a protruding state at the fitting distal end surface side of the housing body 86.

When the shielded connector 100 is fitted with the mating connector 200, an inner peripheral surface of the annular hood portion 82 comes into close contact with the connector packing 80 so as to liquid-tightly fit the annular hood portion 82 with the outer housing 7, and a pair of cam pins 89 are arranged in a protruding state in an outer peripheral surface of the annular hood portion 82.

When the shielded connector 100 is fitted with the mating connector 200, a bottom surface of the annular recessed portion 81*a* abuts the opening end of the front holder 9 and the front holder 9 is pressed and urged toward inside of the terminal accommodating chamber 33 by a fitting pressing force. At the opening end of the front holder 9, a plurality of abutting bosses 96 are arranged in a protruding state and at equal intervals so as to uniformly act the fitting pressing force on the front holder 9.

When the shielded connector 100 is fitted with the mating connector 200, an inner periphery of housing protrusion 83 opposes an end (the left end in FIG. 3) of the shield shell 5 at the side of the insertion direction X via the cutout opening 99*a* of the front holder 9. A shield shell 84 including terminal springs is arranged in a prescribed manner on an inner peripheral surface of the housing protrusion 83. Therefore, the shield shell 84 of the mating connector 200 grounded (earthed) to the cabinet 87 can be conductively connected to the shield shell 5 of the shielded connector 100.

Next, operations when the shielded connector 100 and the mating connector 200 according to the present embodiment are fitted together will be described with reference to FIGS. 6 to 11.

Figure 8:
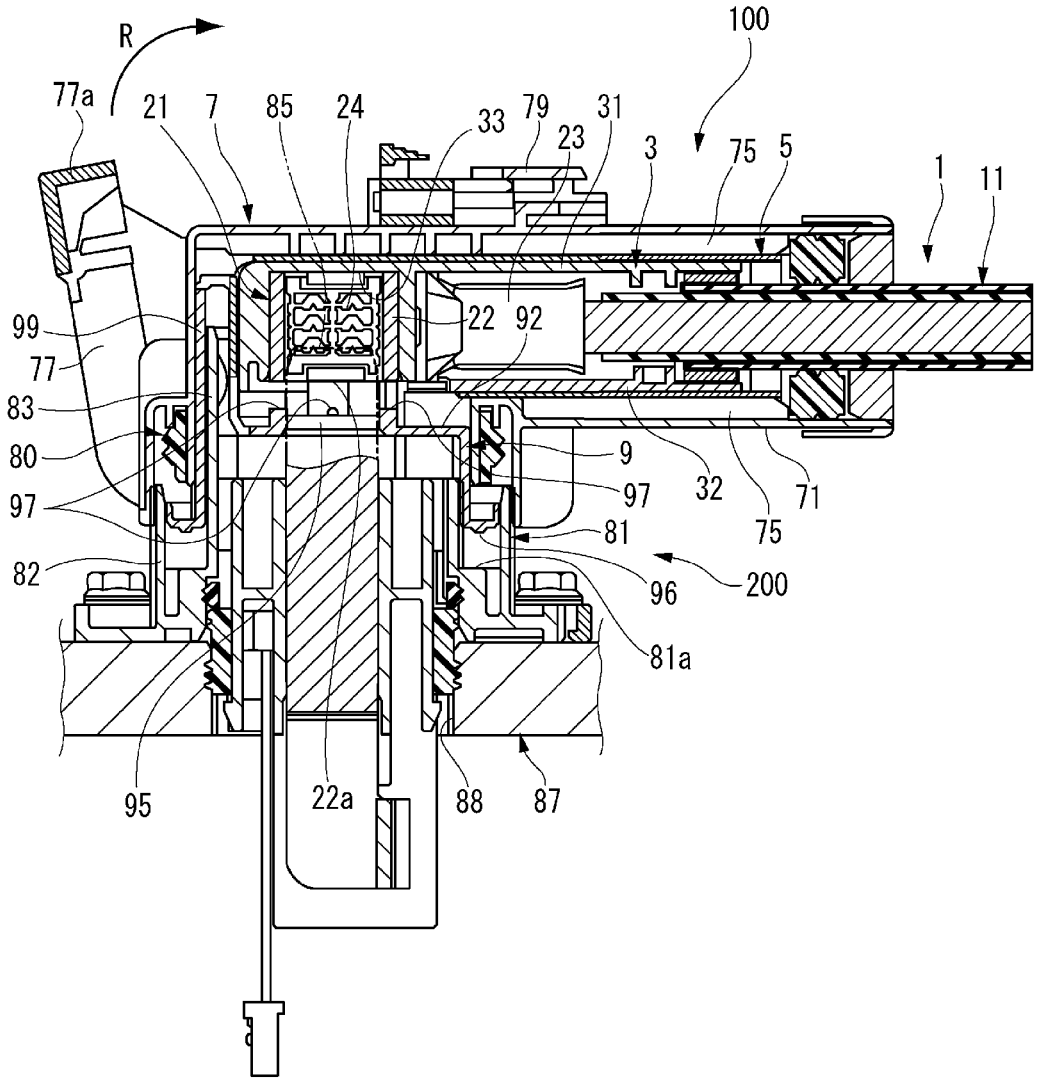
FIG. 8 is a cross section diagram showing the connector and the mating connector in a state at the beginning of fitting together, taken along the line A-A in FIG. 1.
Figure 9:
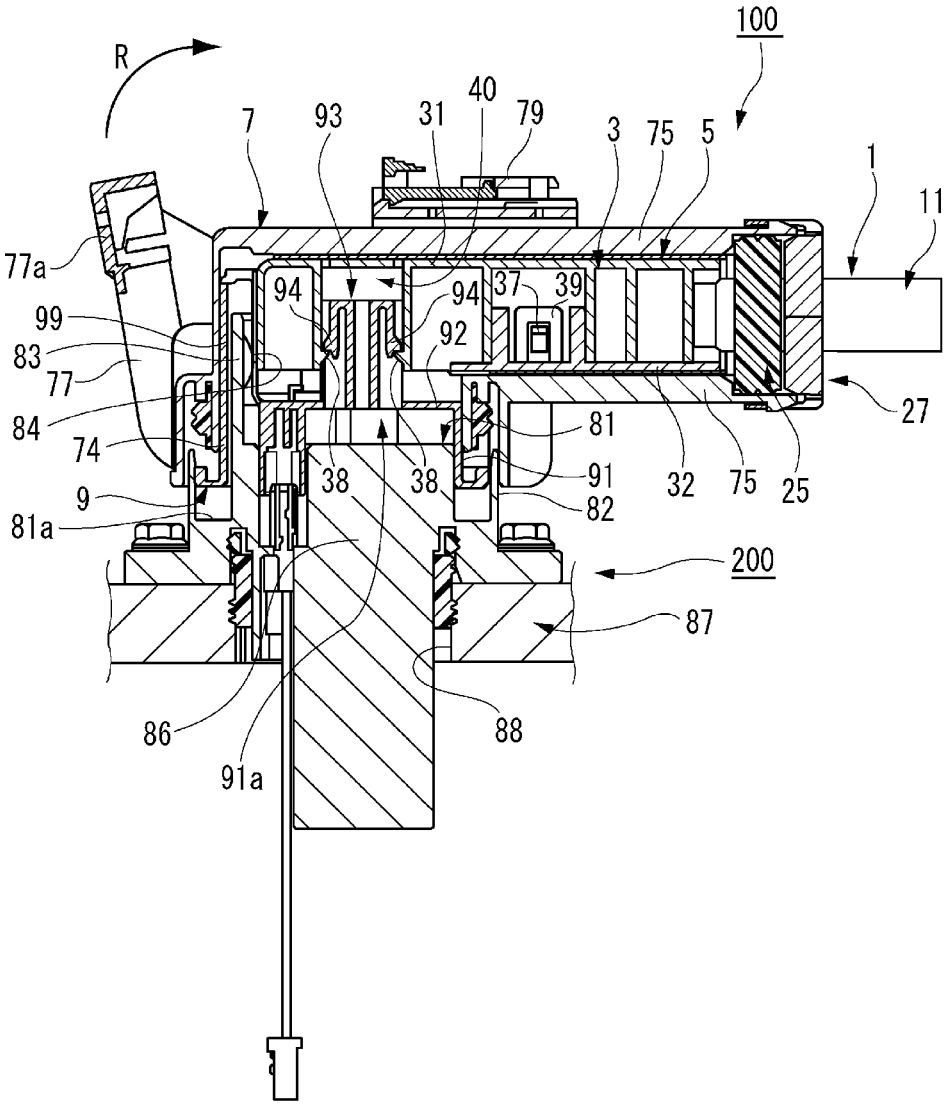
FIG. 9 is a cross section diagram showing the connector and the mating connector in a state at the beginning of fitting together, taken along the line B-B in FIG. 1.
Figure 10:
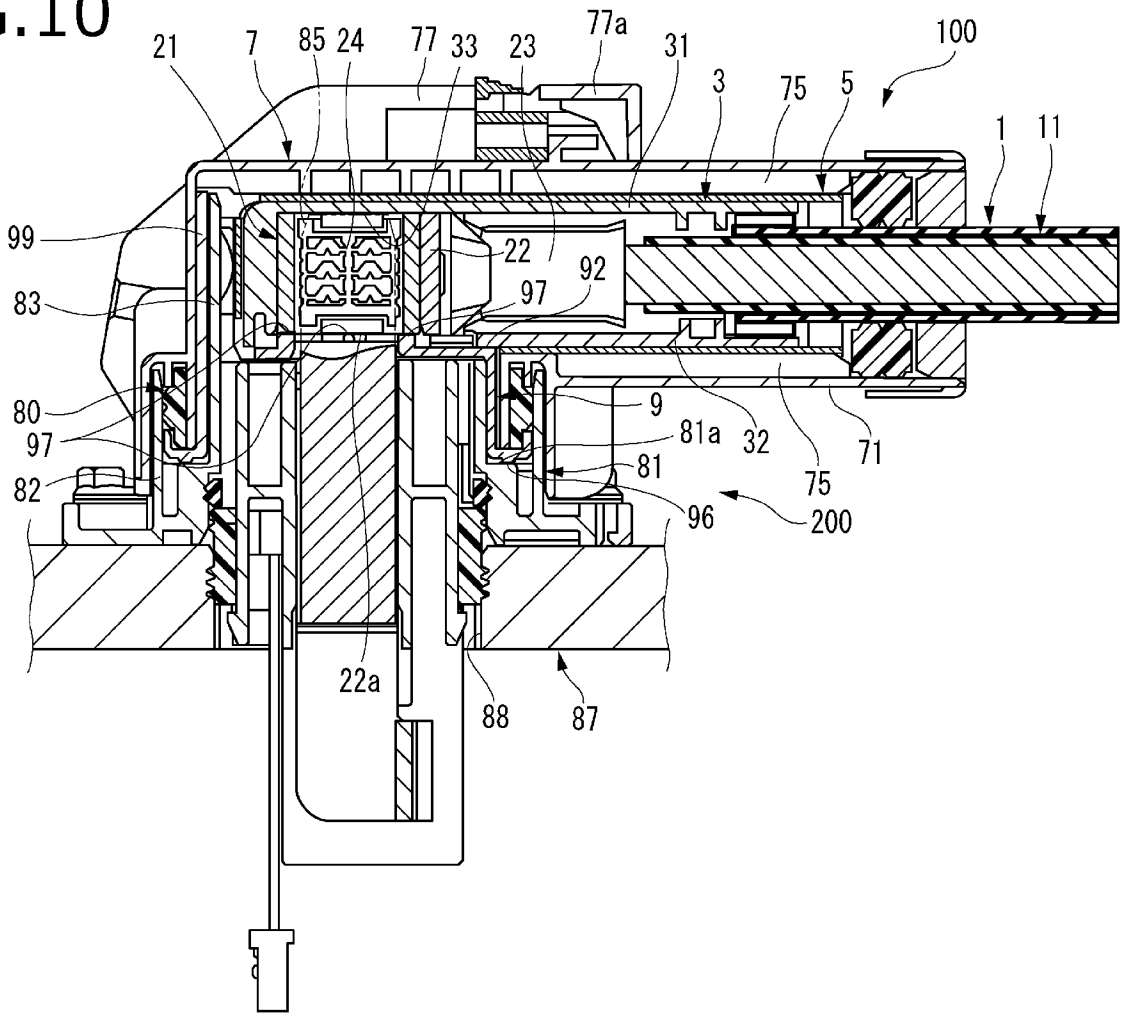
FIG. 10 is a cross section diagram showing the connector and the mating connector in a state at the completion of fitting together, taken along the line A-A in FIG. 1.
Figure 11:
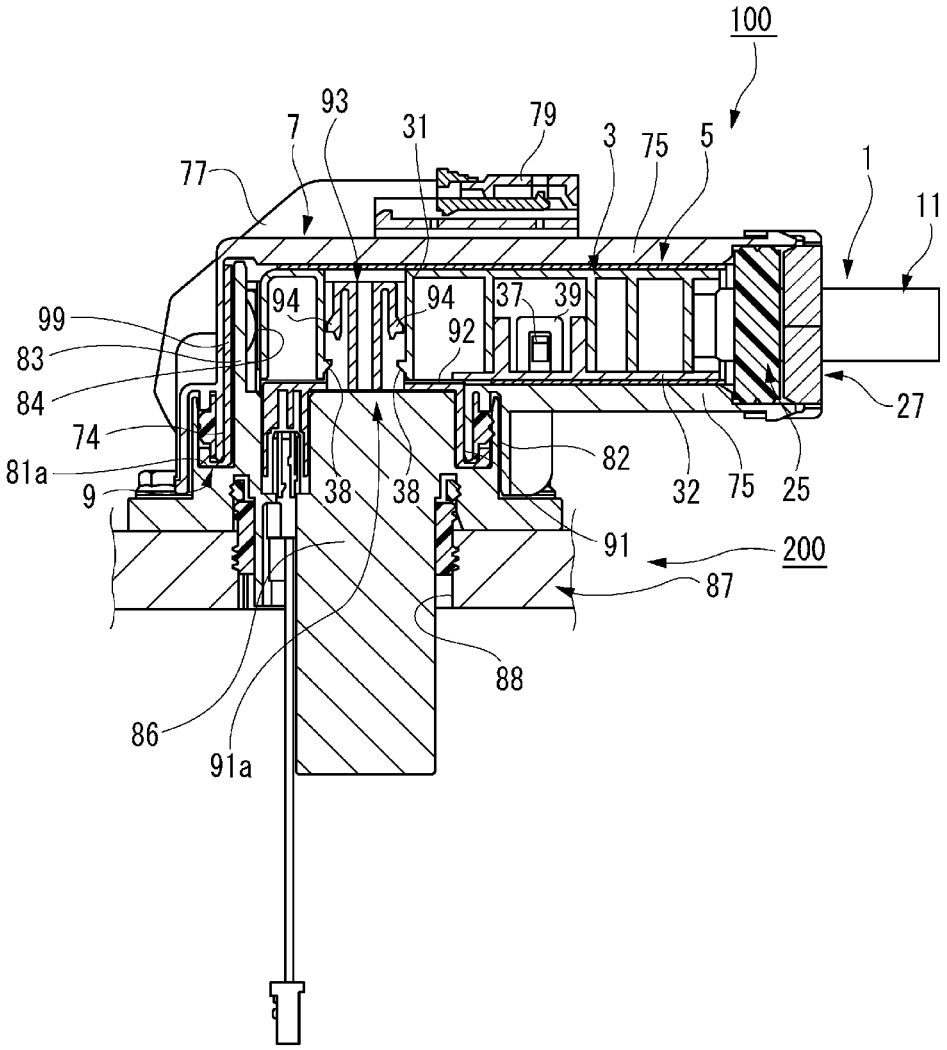
FIG. 11 is a cross section diagram showing the connector and the mating connector in a state at the completion of fitting together, taken along the line B-B in FIG. 1.

FIGS. 6 and 7 are cross section diagrams taken along the line A-A and the line B-B in FIG. 1 showing a state immediately before fitting the shielded connector 100 to the mating connector 200, respectively. FIGS. 8 and 9 are cross section diagrams showing the shielded connector 100 and the mating connector 200 in a state at the beginning of fitting together, taken along the line A-A and the line B-B of FIG. 1, respectively. FIGS. 10 and 11 are cross section diagrams showing the shielded connector 100 and the mating connector 200 in a state at the completion of fitting together, taken along the line A-A and the line B-B of FIG. 1, respectively.

In order to fit the shielded connector 100 and the mating connector 200 according to the present embodiment together, first, as shown in FIGS. 6 and 7, the housing fitting opening 74 of the outer housing 7 is opposed to the mating housing 81 of the mating connector 200. At this time, as shown in FIG. 7, the flexible locking pieces 94 of the columnar guide portion 93 are locked by the locking protrusions 38 of the guide insertion portion 40, and the front holder 9 is held in the temporary locking position with respect to the inner housing 3. That is, the terminal insertion openings 95 of the front holder 9 are located on the side of the housing fitting opening 74 of the outer housing 7 apart from the terminal fitting openings 34 of the inner housing 3.

Next, the mating housing 81 of the mating connector 200 is inserted into the housing fitting opening 74 of the outer housing 7.

Then, as shown in FIGS. 8 and 9, the mating terminals 85 of the mating connector 200 passes through the terminal insertion openings 95 of the front holder 9, and distal ends of the mating terminals 85 are inserted into the opening portions of the box-shaped portions 22 of the terminals 21. Further, the housing main body 86 of the mating housing 81 is fitted into the recessed portion 91*a* of the front holder 9, and the housing protrusion portion 83 of the mating housing 81 is inserted into the holder protrusion portion 99 of the front holder 9. At this time, since the terminal insertion opening 95 of the front holder 9 held at the temporary locking position with respect to the inner housing 3 is located on the side of the housing fitting opening 74 of the outer housing 7, the distal ends of the mating terminals 85 are easy to insert into the insertion openings 95.

Further, the cam pins 89 of the mating housing 81 enter the cam grooves 78 of the lever 77 at a fitting start position.

Next, an operating portion 77*a* of the lever 77 is grasped by a user, and the lever 77 is rotated in the R direction toward the rotation completion position. Then, the cam pins 89 that have entered the cam grooves 78 of the lever 77 to be rotated is pulled in, and the mating housing 81 is drawn to the outer housing 7.

At this time, in the mating housing 81, the bottom surface of the annular recessed portion 81*a* in the housing main body 86 presses and urges the opening end of the opposed front holder 9 toward inside of the terminal accommodating chamber 33 via the contact bosses 96. Therefore, the front holder 9 is pressed and urged toward inside of the terminal accommodating chamber 33 by the fitting pressing force of the mating housing 81, and moves relatively together with the housing main body 86 in the housing fitting opening 74 of the outer housing 7.

When the lever 77 is rotated to a position just before the rotation completion position, the pressing protrusions 97 of the front holder 9 pressed and urged toward inside of the terminal accommodating chamber 33 by the housing main body 86 of the mating housing 81 abut the distal end surface 22*a* of the box-shaped portion 22 of the terminal 21 accommodated in the terminal accommodating chamber 33.

Further, when the lever 77 is rotated to the rotation completion position, as shown in FIGS. 10 and 11, the mating terminals 85 of the mating connector 200 are fitted to and electrically connected to the box-shaped portions 22 of the terminals 21. When the shielded connector 100 is fitted to the mating connector 200, the pressing protrusions 97 of the front holder 9 are elastically deformed by the fitting pressing force acting on the front holder 9 to press and urge the box-shaped portions 22 of the terminals 21 toward inside of the terminal accommodating chambers 33.

Accordingly, the terminals 21 are prevented from rattling in the terminal accommodating chambers 33. As a result, even when the shielded connector 100 according to the present embodiment is used in an automobile or the like, the terminals 21 are prevented from vibrating in the terminal accommodating chambers 33 caused by vibration during running of the automobile, and friction is less likely to occur between the terminals 21 and the mating terminals 85. Therefore, in the shielded connector 100, the situation that contact resistance become unstable due to the friction that occurs between the terminals 21 and the mating terminals 85 will not occur and connection reliability is improved.

In the shielded connector 100 according to the present embodiment, a plurality of pressing protrusions 97 are provided at equal intervals and along the periphery of each of the terminal insertion openings 95 of the front holder 9 opposing the distal end surfaces 22*a* in the fitting direction of the box-shaped portions 22. Therefore, the plurality of pressing projections 97 provided at equal intervals and along the periphery of each of the terminal insertion openings 95 of the front holder 9 can uniformly press and urge the distal end surfaces 22*a* in the fitting direction of the box-shaped portions 22 of the terminals 21 accommodated in the terminal accommodating chambers 33. Accordingly, the box-shaped portions 22 of the terminals 21 are reliably prevented from rattling without inclining in the terminal accommodating chambers 33.

Further, between the front holder 9 and the inner housing 3 according to the present embodiment, a temporary locking mechanism has the flexible locking pieces 94 of the columnar guide portion 93 and the locking projections 38 of the guide insertion portion 40. The temporary locking mechanism holds the front holder 9 in a temporary locking position where the box-shaped portions 22 are not pressed and urged toward inside of the terminal accommodating chambers 33. Therefore, the terminal insertion openings 95 of the front holder 9 held in the temporary locking position are located on the side of the housing fitting openings 74 of the outer housing 7 apart from the terminal fitting openings 34 of the inner housing 3.

Therefore, when the shielded connector 100 is fitted to the mating connector 200, the distal ends of the mating terminals 85 can be easily inserted into the terminal insertion openings 95 of the front holder 9, and the fitting operation becomes easy.

The front holder 9 in the middle of the fitting (before the completion of the fitting) can relatively move toward inside of the terminal accommodating chambers 33 together with the mating housing 81 while holding intermediate portions of the mating terminals 85 passing through the terminal insertion openings 95. Therefore, the mating terminals 85 are smoothly inserted into the opening portions of the box-shaped portions 22 of the terminals 21.

The front holder 9 located in the temporary locking position does not abut against the box-shaped portions 22 of the terminals 21 until the moment just before the fitting is completed. That is, when the distal end portions of the mating terminals 85 are inserted into the opening portions of the box-shaped portions 22, the terminals 21 can move in the terminal accommodating chambers 33, and the insertion force of the mating terminals 85 can be prevented from increasing.

Further, in the shielded connector 100 according to the present embodiment, the lever 77 is rotatably provided in the outer housing 7. The lever 77 includes the cam grooves 78 which draw the mating housing 81 to the outer housing 7 by pulling in the cam pins 89 provided on the mating housing 81 of the mating connector 200 by rotation operation. Therefore, the outer housing 7 and the mating housing 81, which have been fitted together by the rotation operation of the lever 77 that moves the cam pins 89 to the fitting completion position of the cam grooves 78, are constantly urged in the connector fitting direction by cam action. Therefore, the front holder 9, on which the fitting pressing force always acts, can reliably press and urge the box-shaped portions 22 of the terminals 21 toward inside of the terminal accommodating chambers 33.

The connector of the invention is not limited to the lever-fitting connector according to the above-described embodiment. For example, the connector and the mating connector may be fastened by bolts so that the fitting pressing force can always act on the front holder.

Therefore, in the shielded connector 100 according to the present embodiment, the terminal 21 can be prevented from rattling in the inner housing 3 and the connection reliability can be improved.

It is to be noted that the invention is not limited to the above described embodiment, and various modifications, improvements and the like can be appropriately made. In addition, materials, shapes, dimensions, numerals, disposition locations, and the like of each component in the above-described embodiment are arbitrary as long as the object of the invention can be achieved, and are not limited.

Figure 12:
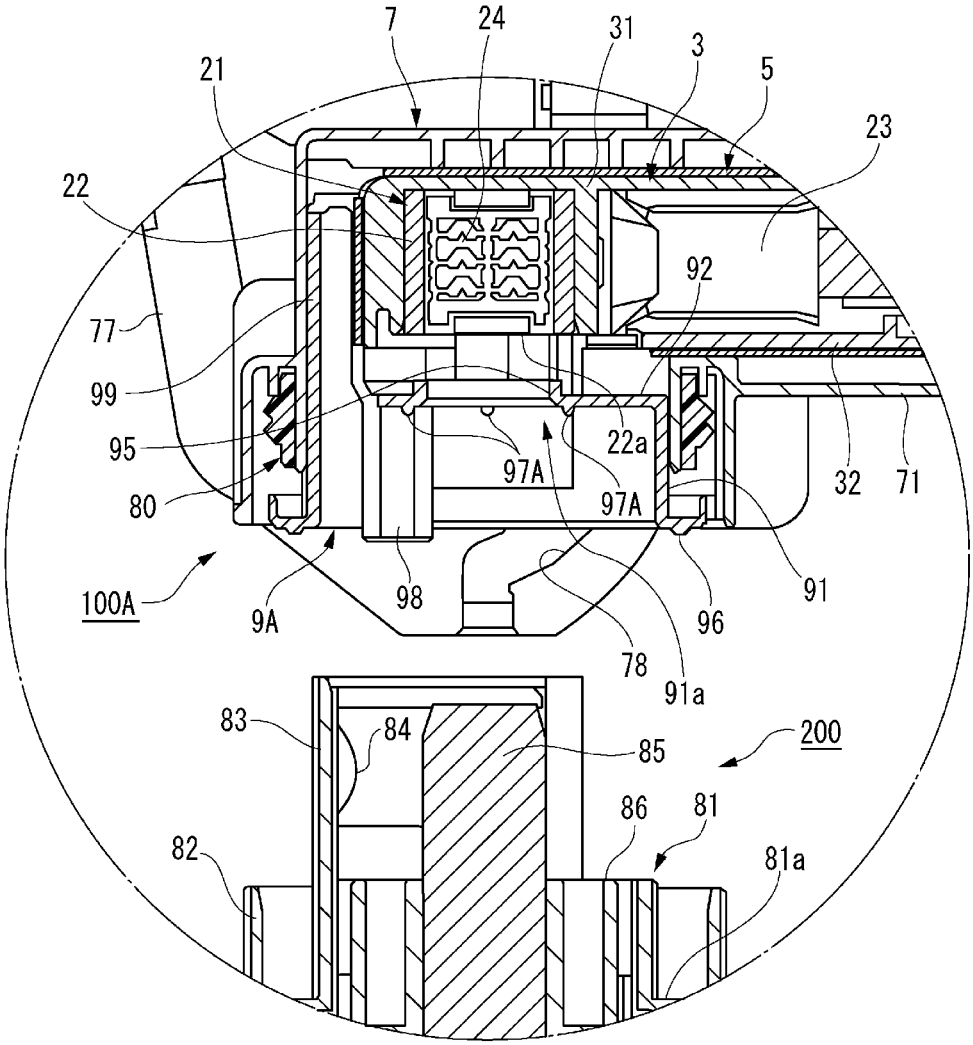
FIG. 12 is an enlarged cross section diagram of a main part, showing a state immediately before fitting a connector and a mating connector according to Embodiment 2 of the invention together.

FIG. 12 is an enlarged cross section diagram of a main part, showing a state immediately before fitting a shielded connector 100A and a mating connector 200 according to Embodiment 2 of the invention together. Since the shielded connector 100A of Embodiment 2 has a similar configuration as that of the shielded connector 100 of Embodiment 1 except that a front holder 9A is used in place of the front holder 9, the similar components are denoted by the same reference numerals, and detailed descriptions thereof are omitted.

As shown in FIG. 12, in the front holder 9A of the shielded connector 100A, a plurality of (four in the present embodiment) pressing protrusions 97A are provided at equal intervals, along the periphery of each of the terminal insertion openings 95, and on an inner surface of a bottom wall 92 opposing the housing main body 86. When the shielded connector 100 A is fitted to the mating connector 200, the pressing protrusions 97A are elastically deformed by a fitting pressing force acting on the front holder 9A to press and urge box-shaped portions 22 toward inside of terminal accommodating chambers 33.

Therefore, similar to the above-described shielded connector 100, in the shielded connector 100A, the situation that contact resistance become unstable due to the friction that occurs between the terminals 21 and the mating terminals 85 will not occur and connection reliability is improved.

Figure 13:
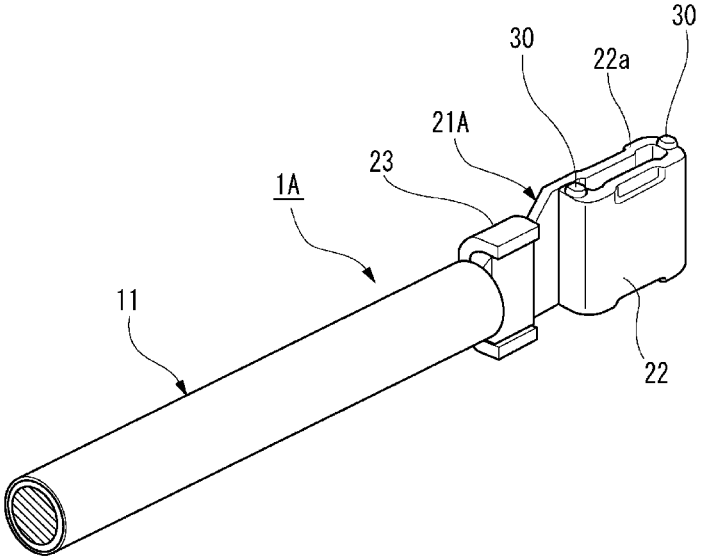
FIG. 13 is a perspective diagram illustrating a terminal-equipped electrical wire of a connector according to Embodiment 3 of the invention.
Figure 14A:
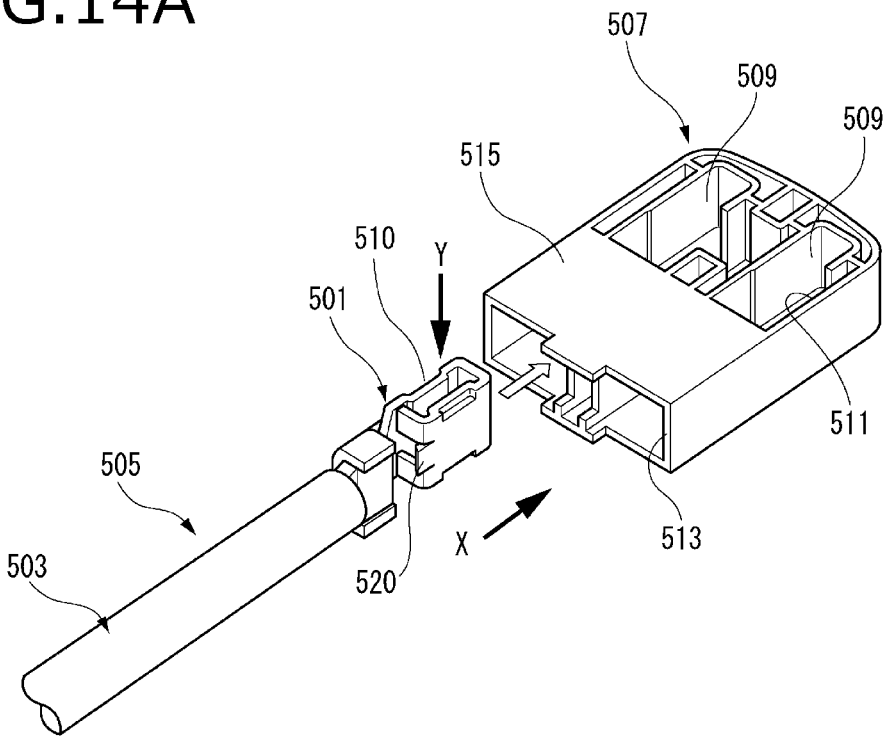
FIG. 14A is an exploded perspective diagram showing an inner housing of a related connector together with a terminal-equipped electrical wire.
Figure 14B:
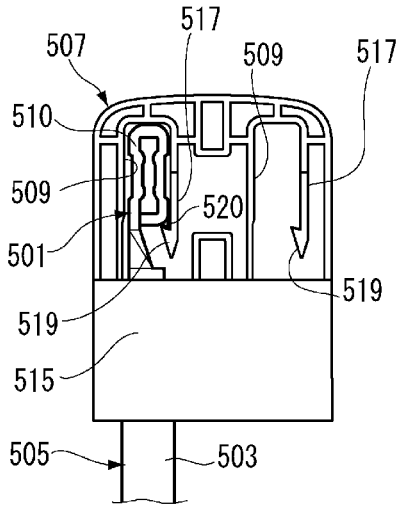
FIG. 14B is a plan view showing a state in which a terminal-equipped electrical wire is inserted to the inner housing shown in FIG. 14A.

FIG. 13 is a perspective diagram illustrating a terminal-equipped electrical wire 1A of a connector according to Embodiment 3 of the invention. Since the terminal-equipped electrical wire 1A of the connector according to Embodiment 3 has a similar configuration as that of terminal-equipped electrical wire 1 according to the above-described embodiments except that a terminal 21A is used in place of the terminal 21, the similar components are denoted by the same reference numerals, and detailed descriptions thereof are omitted.

As shown in FIG. 13, in the terminal 21A of the terminal-equipped electrical wire 1A, a plurality of (two in the present embodiment) pressing protrusions 30 are provided at equal intervals and on a distal end surface 22*a* in fitting direction of a box-shaped portion 22. When the shielded connector provided with a related front holder not including the pressing protrusions 97 is fitted to a mating connector 200, the pressing projections 30 of Embodiment 3 can be elastically deformed by a fitting pressing force acting on the related front holder to press and urge the box-shaped portion 22 toward inside of the terminal accommodating chamber 33.

Therefore, similar to the above-described shielded connectors 100, in the shielded connector according to Embodiment 3 of the present invention, the situation that contact resistance become unstable due to the friction that occurs between the terminal 21A and the mating terminal 85 will not occur and connection reliability is improved.

That is, the pressing protrusions of the invention may be provided on at least one of the terminal and the front holder. The pressing projections 30 and pressing protrusions 97A can be provided on both the terminal 21A and the front holder 9A by using terminal-equipped electrical wires 1A of the connector according to Embodiment 3 to replace the terminal-equipped electrical wires 1 in the shielded connector 100A according to Embodiment 2.

The characteristics of the connectors according to the above-described embodiments of the invention will be briefly summarized and listed in the following items [1] to [4].

[1] A connector (shielded connector 100, 100A), including: a terminal-equipped electrical wires (1) that includes an electrical wire (shielded electrical wire 11) and a terminal (21, 21A) which is attached to an end portion of the electrical wire, the terminal having a box-shaped portion (22) configured to fit with a mating terminal in a fitting direction (Y) intersecting with an extending direction of the electrical wire;

an inner housing (3) that includes a terminal accommodating chamber (33) communicating with a terminal fitting opening (34) and an electrical wire leading-out opening (35) and configured to accommodate the terminal-equipped electrical wire;

an outer housing (7) that includes an electrical wire leading-out opening (72) configured to receive the inner housing in the extending direction of the electrical wire and a housing fitting opening (72) configured to be fitted to a mating connector (200);

a front holder (9, 9A) configured to be attached to the housing fitting opening; and one or more pressing protrusions (97, 97A, 30) provided on at least one of the terminal and the front holder, wherein when the outer housing is fitted to the mating connector, the one or more pressing protrusions are elastically deformed by a fitting pressing force acting on the front holder to press and urge the box-shaped portion toward inside of the terminal accommodating chamber.

[2] The connector (shielded connector 100) according to [1] described above, wherein a plurality of the pressing protrusions are provided at equal intervals and along a periphery of a terminal insertion opening (95) of the front holder (9) opposing a distal end surface (22*a*) of the box-shaped portion (22) in the fitting direction.

[3] The water proof connector (shielded connector 100, 100A) according to [1] or [2] described above, wherein a temporary locking mechanism is provided between the front holder (9) and the inner housing (3) to hold the front holder (9) in a temporary locking position where the box-shaped portion (22) is not pressed and urged toward inside of the terminal accommodating chamber (33).

[4] The connector (100, 100A) according to any one of [1] to [3] described above, wherein a lever (77) having cam grooves (78) is rotatably provided on the outer housing; and the lever draws a mating housing (81) of the mating connector (200) to the outer housing (7) by pulling in cam pins (89) on the mating housing by a rotation operation of the lever.

What is claimed is:

1. A connector, comprising:

a terminal-equipped electrical wire that includes an electrical wire and a terminal which is attached to an end portion of the electrical wire, the terminal having a box-shaped portion configured to fit with a mating terminal in a fitting direction intersecting with an extending direction of the electrical wire;

an inner housing that includes a terminal accommodating chamber communicating with a terminal fitting opening and an electrical wire leading-out opening and configured to accommodate the terminal-equipped electrical wire;

an outer housing that includes an electrical wire leading-out opening configured to receive the inner housing in the extending direction of the electrical wire and a housing fitting opening configured to be fitted to a mating connector;

a front holder configured to be attached to the housing fitting opening; and one or more pressing protrusions provided on at least one of the terminal and the front holder, wherein when the outer housing is fitted to the mating connector, the one or more pressing protrusions are elastically deformed by a fitting pressing force acting on the front holder to press and urge the box-shaped portion toward inside of the terminal accommodating chamber.

2. The connector according to claim 1, wherein a plurality of the pressing protrusions are provided at equal intervals and along a periphery of a terminal insertion opening of the front holder opposing a distal end surface of the box-shaped portion in the fitting direction.

3. The connector according to claim 1, wherein a temporary locking mechanism is provided between the front holder and the inner housing to hold the front holder in a temporary locking position where the box-shaped portion is not pressed and urged toward inside of the terminal accommodating chamber.

4. The connector according to claim 1, wherein a lever having cam grooves is rotatably provided on the outer housing; and wherein the lever draws a mating housing of the mating connector to the outer housing by pulling in cam pins on the mating housing by a rotation operation of the lever.

* * * * *